US006329951B1

(12) United States Patent
Wen et al.

(10) Patent No.: US 6,329,951 B1
(45) Date of Patent: Dec. 11, 2001

(54) ELECTRICALLY CONNECTED MULTI-FEED ANTENNA SYSTEM

(75) Inventors: Geyi Wen; Yihong Qi, both of Waterloo; Perry Jarmuszewski, Guelph, all of (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 09/543,176

(22) Filed: Apr. 5, 2000

(51) Int. Cl.[7] ..... H01Q 1/24

(52) U.S. Cl. ..... 343/702; 343/795; 343/727; 343/730

(58) Field of Search ..... 343/702, 793, 343/795, 725, 727, 729, 730, 752; H01Q 1/24

(56) References Cited

U.S. PATENT DOCUMENTS 5,257,032 * 10/1993 Diamond et al. ..... 343/730
5,457,469 * 10/1995 Diamond et al. ..... 343/730
5,767,811 * 6/1998 Mandai et al. ..... 343/702
5,870,066 * 2/1999 Asakura et al. ..... 343/895
5,872,546 * 2/1999 Ihara et al. ..... 343/730
5,973,651 * 10/1999 Suesada et al. ..... 343/702
6,028,568 * 2/2000 Asakura et al. ..... 343/702

* cited by examiner

*Primary Examiner*—Hoanganh Le
(74) *Attorney, Agent, or Firm*—Jones, Day, Reavis & Pogue

(57) ABSTRACT

An antenna system for a portable transceiver device comprises an antenna structure for transmitting and receiving RF signals. The antenna structure includes multiple feeding ports having a common structure fully coupling multiple antennas together. This antenna structure is made of a conductor that can be surface mounted over a nonplanar surface. When the conductor is mounted on a nonplanar surface, the antenna structure extends in three dimensional space around the portable communications device.

32 Claims, 2 Drawing Sheets

ELECTRICALLY CONNECTED MULTI-FEED ANTENNA SYSTEM

FIELD OF THE INVENTION

The present invention relates to antennas that can send and receive signals from a radio frequency device. In particular the present invention relates to antennas that are used in portable hand held devices.

BACKGROUND OF THE INVENTION

An antenna is a transforming device that converts circuit currents into electromagnetic energy. Conversely, the antenna can convert electromagnetic energy into circuit currents. The frequency to which the antenna responds is based on characteristics of the antenna such as width and length. Changes in the width and length of the antenna affect the resistance of the antenna and shape the current densities along the length of the antenna. The antenna field can be affected by nearby objects, such as other antennas, which distort the performance of the antenna.

There remains a need for a portable hand-held communications device that implements an antenna in at least a transmitting or a receiving configuration. Ideally, the antenna conforms to the housing of the device and is positioned so that the antenna will transmit and receive regardless of the orientation of the device relative to the communications station.

SUMMARY OF THE INVENTION

An antenna system for a portable transceiver device comprises an antenna structure for transmitting and receiving RF signals. The antenna structure includes multiple feeding ports having a common structure fully coupling multiple antennas together. This antenna structure is made of a conductor that can be surface mounted over a nonplanar surface. When the conductor is mounted on a nonplanar surface, the antenna structure extends in three-dimensional space around the portable hand held communications device.

More accordingly, as a principal feature of the invention, an antenna system comprises an antenna structure, a first feeding port, and a second feeding port. The first and second feeding ports connect the antenna structure to communications circuitry. The antenna structure forms a first antenna structure connected to the first feeding port and further forms a second antenna structure connected to the second feeding port. Importantly, a portion of the first antenna structure is also a portion of the second antenna structure.

According to the present invention, there is also provided a portable communications device comprising: a transmitting circuit; a receiving circuit; and an antenna system, wherein the antenna system comprises a first antenna structure and a second antenna structure which has a common portion of a radiation element fully coupling the first antenna structure to the second antenna structure. Preferably, the first antenna structure and the second antenna structure include a monopole antenna, a dipole antenna, and a top loaded member wherein the top loaded member is a portion of the first antenna structure and the second antenna structure. Preferred applications of the present invention include portable communication devices, wireless PDAs, and two-way paging devices.

Some of the advantages provided by the present invention include: high efficiency, high gain, wide bandwidth, and low SAR. In addition, the present invention allows for use of one piece of wire to realize two different antenna functions simultaneously. Further still, the present invention's use of two feeding points will allow optimization of the radio board layout to minimize EMI problems. Further and advantageously, there is no performance issue regarding coupling between antennas in the present invention as in traditional separate two antenna solutions wherein the coupling between the antennas degrades the antenna performance. Another advantage of the present invention is the simple layout. In the present invention a folded dipole is used as a transmitting antenna to raise the antenna radiation resistance thereby increasing efficiency. Traditional dipoles and monopoles that are widely used in wireless devices are very sensitive to a change in the environment. In contrast, the present invention is less sensitive to the environment by taking advantage of the environment by reducing the effects of the same. Further still, the present invention allows the potential for increasing bandwidth by appropriately changing wire lengths. Finally, the present invention allows for lower manufacturing cost due to simpler layout.

DESCRIPTION OF THE PREFERRED EMBODIMENT

Figure 1:
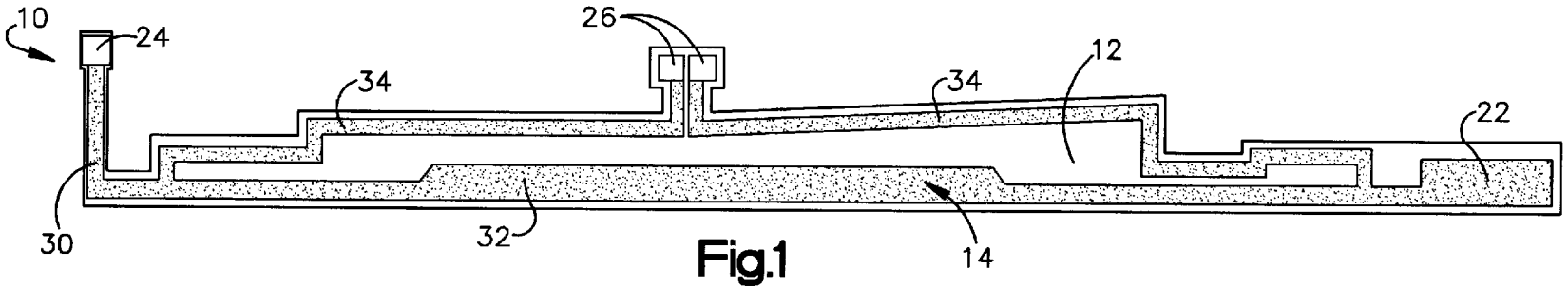
FIG. 1 is a top view of an antenna system comprising a preferred embodiment of the invention.

An antenna system 10 comprising a preferred embodiment of the present invention is shown in FIG. 1. The antenna system 10 comprises a backing substrate 12, and an antenna structure 14. The backing substrate 12 is made of a thin, flexible material. Preferably, the antenna structure 14 is made of a low resistance conductor and affixed to the backing substrate 12. In this manner, the antenna system 10 is a laminate with layers of the antenna structure 14 and the backing substrate 12.

The antenna structure 14 has distinct portions defining a radiating element, a top loading member 22, a monopole feeding port 24, and a dipole feeding port 26. The radiating element is a conductor that extends from the feeding ports 24 and 26 to the top loading member 22. Portions of the radiating element include: a monopole portion 30, a common portion 32, and a dipole portion 34. These portions 30–34 are configured so that the radiating member includes a first antenna structure 40(as shown in FIG. 3) that functions as an effective monopole antenna and a second antenna structure 44(as shown in FIG. 4) that functions as an effective dipole antenna.

Figure 3:
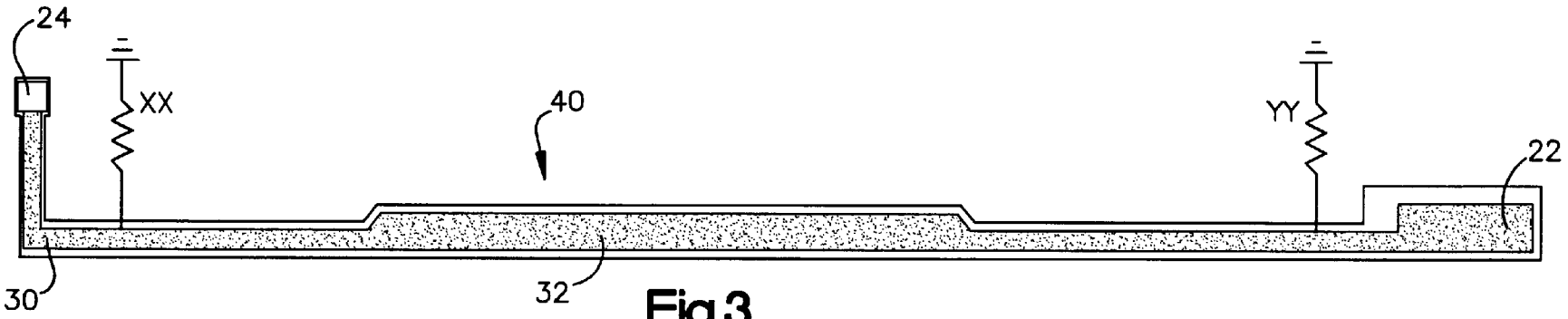
FIG. 3 is a partial view of the antenna system of FIG. 1.
Figure 4:
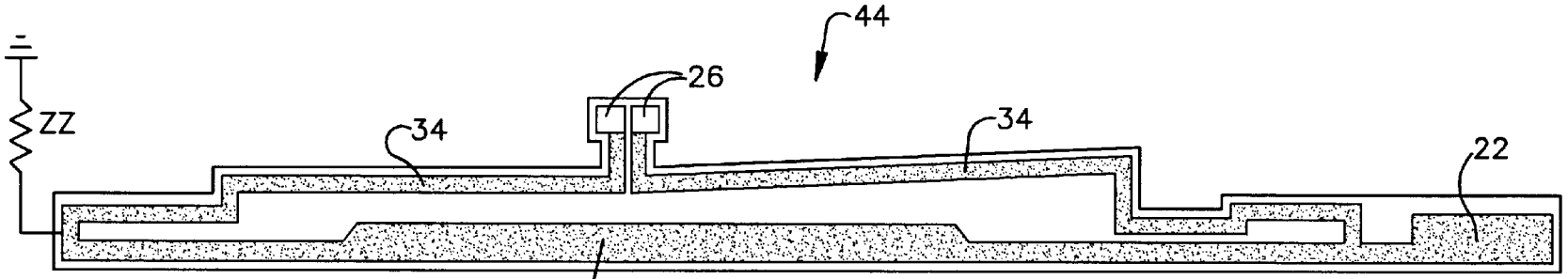
FIG. 4 also is a partial view of the antenna system of FIG. 1.

When the antenna system 10 is excited from the monopole feeding port 24, the dipole feeding port 26 and the dipole portion 34 of the antenna structure 14 are a load on the effective monopole antenna 40 (indicated as XX and YY on FIG. 3). When the system is excited from the dipole feeding port 26, the monopole feeding port 24 and the monopole portion 30 of the antenna structure 14 are a load on the effective dipole antenna 44(indicated as ZZ on FIG. 4).

The effective monopole antenna 40 includes a current path along the radiating element between the monopole feeding port 24 and the top loading member 22. As shown in FIG. 3, the primary path of the effective monopole antenna 40 is defined by the monopole portion 30, the common portion 32 and the top loading member 22. The loads XX and YY between the monopole feeding port 24 and the top loading member 22 have a high impedance, and consequently, very small amounts of current are delivered through the loads. The effective dipole antenna 44 includes a current path along the radiating element between the dipole feeding port 26 and the top loading member 22. As shown in FIG. 4, the path of the effective dipole antenna 44 comprises the dipole portion 30, the common portion 32, and the top loading member 22. The load ZZ between the dipole feeding port 26 and the top loading member 22 has a high impedance, and consequently, a very small amount of current is delivered through the load.

A dielectric housing 46 is a box-shaped container made of a dielectric material. The dielectric housing 46 has a top and bottom surface 52 and 54, a front and back surface 56 and 58, and opposite side surfaces 60 and 62. Within the dielectric housing 46 is a transmitting circuit 70 and a receiving circuit 74. The dielectric housing 46 holds the electronics of the transmitting circuit 70 and the receiving circuit 74.

Figure 2:
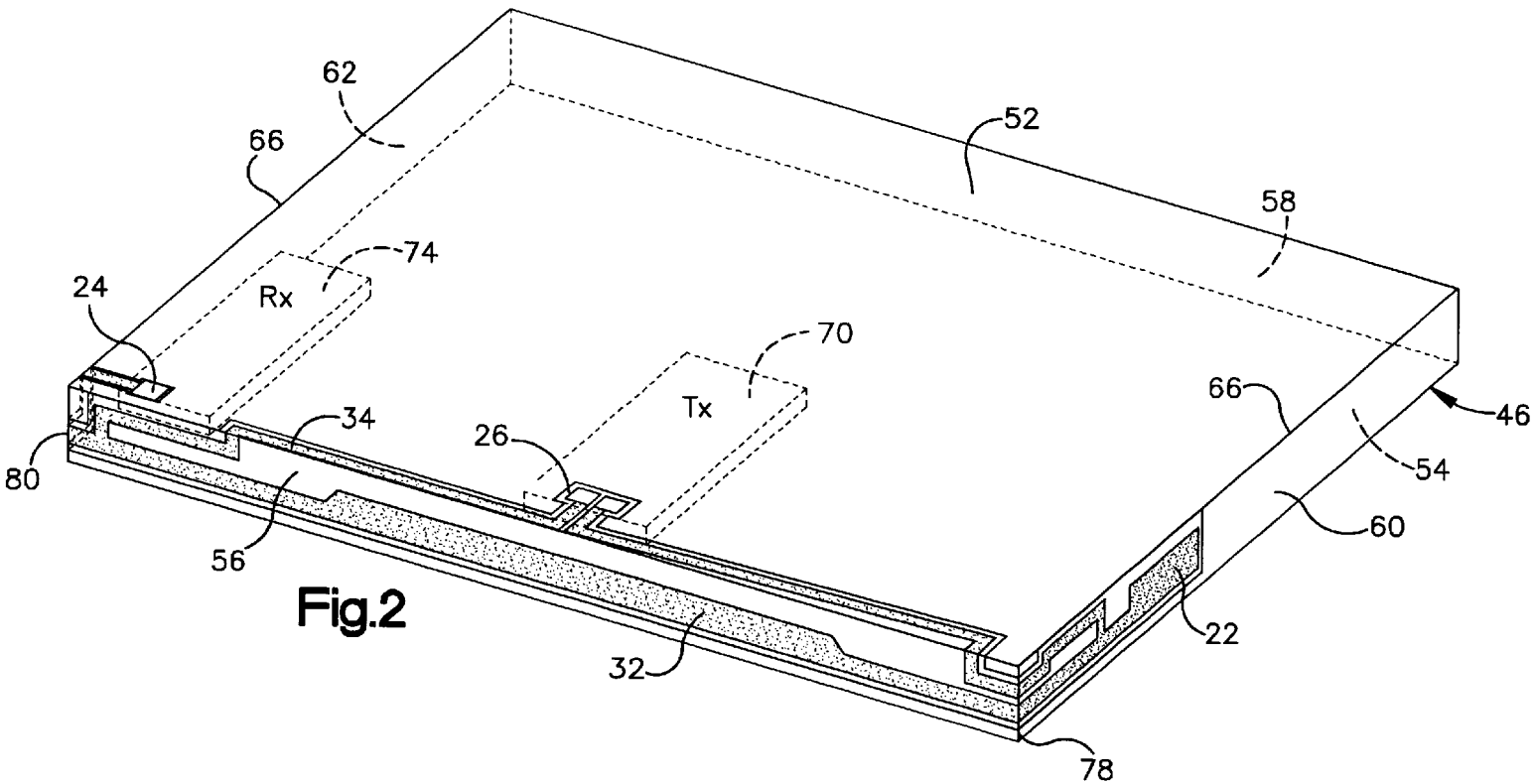
FIG. 2 is an orthogonal view of the antenna system of FIG. 1 mounted on a telecommunications device housing.

The antenna system 10 is folded from the original, flat configuration of FIG. 1 to the configuration in which it is mounted on the inside of the dielectric housing 46, as shown in FIG. 2. The antenna system 10 then extends around the dielectric housing 46 to orient the antenna structure 14 in multiple perpendicular planes. The top loading member 22 and the common portion 32 of the radiating element are mounted on the side surface 60. The common portion 32 and the dipole portion 34 of the radiating element extend around a front comer 78 from the side surface 60 to the front surface 56. The common portion 32 extends fully along the front surface 56 to the opposite comer 80. The dipole portion 34 turns upward from the front surface 56 to the top surface 52 and extends along the top surface 52. The dipole feeding port 26 also is located on the top surface 52 of the dielectric housing 46. Near the comer 80, the dipole portion 34 turns down from the top surface 52 back onto the front surface 56. The monopole portion 30 turns around the far front comer 80 from the front surface 56 to the far side surface 62 and again turns from the side surface 62 upward onto the top surface 52. The effective monopole antenna 40 and the effective dipole antenna 44 each extend in a plane parallel to the front surface 56, and planes parallel to the top surface 52, and the side surface 60. This orientation of the antenna system 10 makes the portable communications device 56 an omnidirectional transmit and receive device.

The monopole feeding port 24 is connected to the receiving circuit 74. The dipole feeding port 26 is connected to the transmitting circuit 70. Importantly, the current distributed from the monopole feeding port 24 mainly flows along the effective monopole antenna 40 while a small amount of current travels along the loads XX and YY. Since these loads are the high impedances of the dipole portion 34, dipole feeding port 26 and transmitting circuitry 70, the current distribution along the effective monopole antenna 40 is minimally changed. Similarly, when current is distributed from the dipole feed port 26, the current mainly flows along the effective dipole antenna 44 while a small amount of current travels along the load ZZ. Since the load ZZ is the high impedance of the monopole portion 30, monopole feeding port 24 and receiving circuit 74, the current distribution along the effective dipole antenna 44 is minimally changed. This configuration is important in the operation of the antenna system 10 in its transmit and receive states.

The effective monopole antenna 40 is sized to receive signals from a radio wave at a particular frequency by defining the length and width of its radiating element appropriately. Since the loads XX and YY have a high impedance, most of the current generated along the antenna structure 14 from the received radio signal is distributed along the effective monopole antenna 40. The length of the common portion 32 of the radiating element is sized so that the antenna is tuned to the chosen frequency for receiving signals.

The effective dipole antenna 44 is sized to transmit a signal at a specified frequency by defining the length and width of its radiating element appropriately. The high impedance of the load ZZ of the antenna structure 14 forces the current from the transmitting circuit 70 to flow along the effective dipole antenna 44. The length of the effective dipole antenna 44 is the length of both the common portion 32 and the dipole portion 34. The dipole portion 34 can thus be sized with the prior knowledge of the length of the common portion 32 to convert the circuit currents of the transmitting antenna to an electromagnetic signal at the desired frequency.

The top loading member 22 of the antenna structure 14 further alters the current distribution of each effective antenna 40 and 44. The top loading member thus further shapes the characteristics of each effective antenna 40 and 44 by adding perceived length to the antenna structure 14.

The invention has been described with reference to a preferred embodiment. Those skilled in the art will perceive improvements, changes, and modifications. Such improvements, changes, and modifications are intended to be within the scope of the claims.

What is claimed is:

1. An antenna system comprising:

an antenna structure;

a first feeding port configured to connect the antenna structure to communications circuitry; and a second feeding port configured to connect the antenna structure to communications circuitry, wherein the antenna structure forms a first antenna structure of a first antenna type connected to the first feeding port and a second antenna structure of a second antenna type connected to the second feeding port, and wherein a portion of the first antenna structure also comprises a portion of the second antenna structure.

2. The antenna system of claim 1, wherein the first antenna structure and the second antenna structure include a monopole antenna.

3. The antenna system of claim 1, wherein the first antenna structure and the second antenna structure include a dipole antenna.

4. The antenna system of claim 1, wherein the first antenna structure and the second antenna structure comprise a top loaded member.

5. The antenna system of claim 4, wherein the top loaded member is a portion of the first antenna structure and the second antenna structure.

6. The antenna system of claim 1, wherein the antenna system is operable in a portable communication device.

7. The antenna system of claim 1, wherein the antenna system is operable in a wireless PDA.

8. The antenna system of claim 1, wherein the antenna system is operable in a less paging device.

9. The antenna system of claim 1, wherein the antenna system is operable in a less two-way paging device.

10. A portable communications apparatus, comprising:

a transmitting circuit;

a receiving circuit; and an antenna system, wherein the antenna system comprises a first antenna structure of a first antenna type and a second antenna structure of a second antenna type, and wherein the first and second antenna structures share a common portion of a radiation element that couples the first antenna structure to the second antenna structure.

11. The antenna system of claim 10, wherein the first antenna structure and the second antenna structure include a monopole antenna.

12. The antenna system of claim 10, wherein the first antenna structure and the second antenna structure include a dipole antenna.

13. The antenna system of claim 10, wherein the first antenna structure and the second antenna structure comprise a top loaded member.

14. The antenna system of claim 13, wherein the top loaded member is a portion of the first antenna structure and the second antenna structure.

15. The antenna system of claim 10, wherein the antenna system is operable in a portable communication device.

16. The antenna system of claim 10, wherein the antenna system is operable in a wireless PDA.

17. The antenna system of claim 10, wherein the antenna system is operable in a wireless paging device.

18. The antenna system of claim 10, wherein the antenna system is operable in a wireless two-way paging device.

19. An antenna system, comprising:

an antenna structure;

a first feeding port configured to connect the antenna structure to communications circuitry; and a second feeding port configured to connect the antenna structure to communications circuitry, wherein the antenna structure forms a monopole antenna connected to the first feeding port and a dipole antenna connected to the second feeding port, and wherein a portion of the monopole antenna is also a portion of the dipole antenna.

20. The antenna system of claim 19, wherein the monopole antenna and the dipole antenna comprise a top loaded member.

21. The antenna system of claim 20, wherein the top loaded member is a portion of the monopole antenna and the dipole antenna.

22. The antenna system of claim 19, wherein the antenna system is operable in a portable communication device.

23. The antenna system of claim 19, wherein the antenna system is operable in a wireless PDA.

24. The antenna system of claim 19, wherein the antenna system is operable in a wireless paging device.

25. The antenna system of claim 19, wherein the antenna system is operable in a wireless two-way paging device.

26. A portable communications apparatus, comprising:

a transmitting circuit;

a receiving circuit; and an antenna system, wherein the antenna system comprises a monopole antenna and a dipole antenna, the monopole antenna and the antenna including a common portion of a radiation element that couples the monopole antenna to the dipole antenna.

27. The antenna system of claim 26, wherein the monopole antenna and the dipole antenna comprise a top loaded member.

28. The antenna system of claim 27, wherein the top loaded member is a portion of the monopole antenna and the dipole antenna.

29. The antenna system of claim 26, wherein the antenna system is operable in a portable communication device.

30. The antenna system of claim 26, wherein the antenna system is operable in a wireless PDA.

31. The antenna system of claim 26, wherein the antenna system is operable in a wireless paging device.

32. The antenna system of claim 26, wherein the antenna system is operable in a wireless two-way paging device.

* * * * *

UNITED STATES PATENT AND TRADEMARK OFFICE

CERTIFICATE OF CORRECTION

PATENT NO. : 6,329,951 B1
DATED : December 11, 2001
INVENTOR(S) : Geyi Wen, Yihong Qi, and Perry Jarmuszewski It is certified that error appears in the above-identified patent and that said Letters Patent is hereby corrected as shown below:

Column 4,
Line 65, change "less" to -- wireless --
Line 67, change "less" to -- wireless --

Column 6,
Line 23, change "and the antenna" to -- and the dipole antenna --

Signed and Sealed this

Twenty-first Day of May, 2002

*Attest:*

*Attesting Officer*

JAMES E. ROGAN
*Director of the United States Patent and Trademark Office*